US007646852B2

(12) United States Patent
Harding

(10) Patent No.: US 7,646,852 B2
(45) Date of Patent: Jan. 12, 2010

(54) METHOD, A PROCESSOR, AND A SYSTEM FOR TRACKING A FOCUS OF A BEAM

(75) Inventor: Geoffrey Harding, Hamburg (DE)

(73) Assignee: GE Security, Inc., Bradenton, FL (US)

( * ) Notice: Subject to any disclaimer, the term of this patent is extended or adjusted under 35 U.S.C. 154(b) by 60 days.

(21) Appl. No.: 12/006,140

(22) Filed: Dec. 31, 2007

(65) Prior Publication Data

US 2009/0168957 A1 Jul. 2, 2009

(51) Int. Cl.
*H01J 35/30* (2006.01)
*H01J 35/14* (2006.01)
*H05G 1/32* (2006.01)

(52) U.S. Cl. ..... 378/137; 378/138; 378/111

(58) Field of Classification Search ..... 378/98.6, 378/98.7, 113, 137, 119, 121, 138, 143, 111
See application file for complete search history.

(56) References Cited

U.S. PATENT DOCUMENTS 4,963,746 A 10/1990 Morgan et al.
5,627,871 A * 5/1997 Wang ..... 378/121
5,682,412 A 10/1997 Skillicorn et al.
6,438,207 B1 * 8/2002 Chidester et al. ..... 378/138
6,778,633 B1 * 8/2004 Loxley et al. ..... 378/113
6,807,248 B2 10/2004 Mihara et al.
6,816,564 B2 11/2004 Charles, Jr. et al.
6,917,396 B2 7/2005 Hiraishi et al.
6,975,752 B2 12/2005 Dixon et al.
7,283,613 B2 10/2007 Harding
7,428,298 B2 * 9/2008 Bard et al. ..... 378/138
2007/0158573 A1 7/2007 Deych

* cited by examiner

*Primary Examiner*—Irakli Kiknadze
(74) *Attorney, Agent, or Firm*—Eugene Hyun, Esq.; Armstrong Teasdale LLP

(57) ABSTRACT

A system, a processor, and a method for tracking a focus of a beam are described. The method includes determining a plurality of intensities corresponding to a plurality of voltages, and applying a first voltage of the plurality of voltages corresponding to a maximum intensity of the plurality of intensities during a scan.

20 Claims, 7 Drawing Sheets

METHOD, A PROCESSOR, AND A SYSTEM FOR TRACKING A FOCUS OF A BEAM

FIELD OF THE INVENTION

The field of the invention relates generally to a method, a processor, and a system for correcting a change in an anode and, more particularly, to a method, a processor, and a system for tracking a focus of a beam.

BACKGROUND OF THE INVENTION

The events of Sep. 11, 2001 instigated an urgency for more effective and stringent screening of airport baggage. The urgency for security expanded from an inspection of carry-on bags for knives and guns to a complete inspection of checked bags for a range of objects and/or materials with particular emphasis upon concealed explosives. X-ray diffraction imaging (XDI) is a technology currently employed for screening. In XDI, an X-ray source sends an X-ray beam via a primary collimator towards one or more potential threat materials, which are identified by means of their X-ray diffraction (XRD) profile, and a transmission detector detects an undeflected portion of the X-ray beam to determine an attenuation of the undeflected portion.

The X-ray source includes an anode and a cathode that generates an electron beam. As the anode is heated by the electron beam, the anode expands and a focus of the X-ray source may move outside an acceptance window of the primary collimator. An acceptance window of the primary collimator is a window inside of which the primary collimator transmits a portion of X-rays incident on the primary collimator. The movement of the focus deteriorates an amount of X-rays that pass through the primary collimator and reduces a number of photons that are detected by the detector. The reduction in the number of photons detected by the detector leads to a lower number of photons represented by an XRD profile, poor detection, and increase in the false alarm rate of the detection of the treat materials, such as a plastic explosive.

BRIEF DESCRIPTION OF THE INVENTION

A brief description of embodiments of a method, a processor, and a system for tracking a focus of a beam follows.

In one aspect, a method for tracking a focus of a beam is described. The method includes determining a plurality of intensities corresponding to a plurality of voltages, and applying a first voltage of the plurality of voltages corresponding to a maximum intensity of the plurality of intensities during a scan.

In another aspect, a processor is described. The processor is configured to determine a plurality of intensities corresponding to a plurality of voltages, and send a signal to apply a first voltage of the plurality of voltages corresponding to a maximum intensity of the plurality of intensities during a scan.

In yet another aspect, a system for tracking a focus of a beam is described. The system includes an X-ray source configured to generate X-rays, a detector configured to detect the X-rays and generate an electrical output signal representative of the detected X-rays, and a processor. The processor is configured to determine a plurality of intensities corresponding to a plurality of voltages. One of the plurality of intensities corresponds to the electrical output signal. The processor is further configured to send a signal to apply a first voltage of the plurality of voltages corresponding to a maximum intensity of the plurality of intensities during a scan.

BRIEF DESCRIPTION OF THE DRAWINGS

FIG. 1 is an isometric view of an embodiment of a system for measuring an X-ray diffraction profile.

FIG. 2 is block diagram of an embodiment of a system for measuring an X-ray diffraction profile.

FIG. 3 is a block diagram of an embodiment of a system for measuring an X-ray diffraction profile.

FIG. 4 is a block diagram of an alternative embodiment of a system for tracking a focus of a beam.

FIG. 5 is a block diagram of an embodiment of a system for tracking a focus of a beam.

FIG. 6 is a flowchart of an embodiment of a method for tracking a focus of a beam.

FIG. 7 is a continuation of the flowchart of FIG. 6.

FIG. 8 is a continuation of the flowchart of FIG. 7.

FIG. 9 is a continuation of the flowchart of FIG. 8.

FIG. 10 is a continuation of the flowchart of FIG. 9.

DETAILED DESCRIPTION OF THE INVENTION

While described in terms of detecting contraband including, without limitation, weapons, explosives, and/or narcotics, within baggage, the embodiments described herein can be used for any suitable diffraction imaging application.

Figure 1:
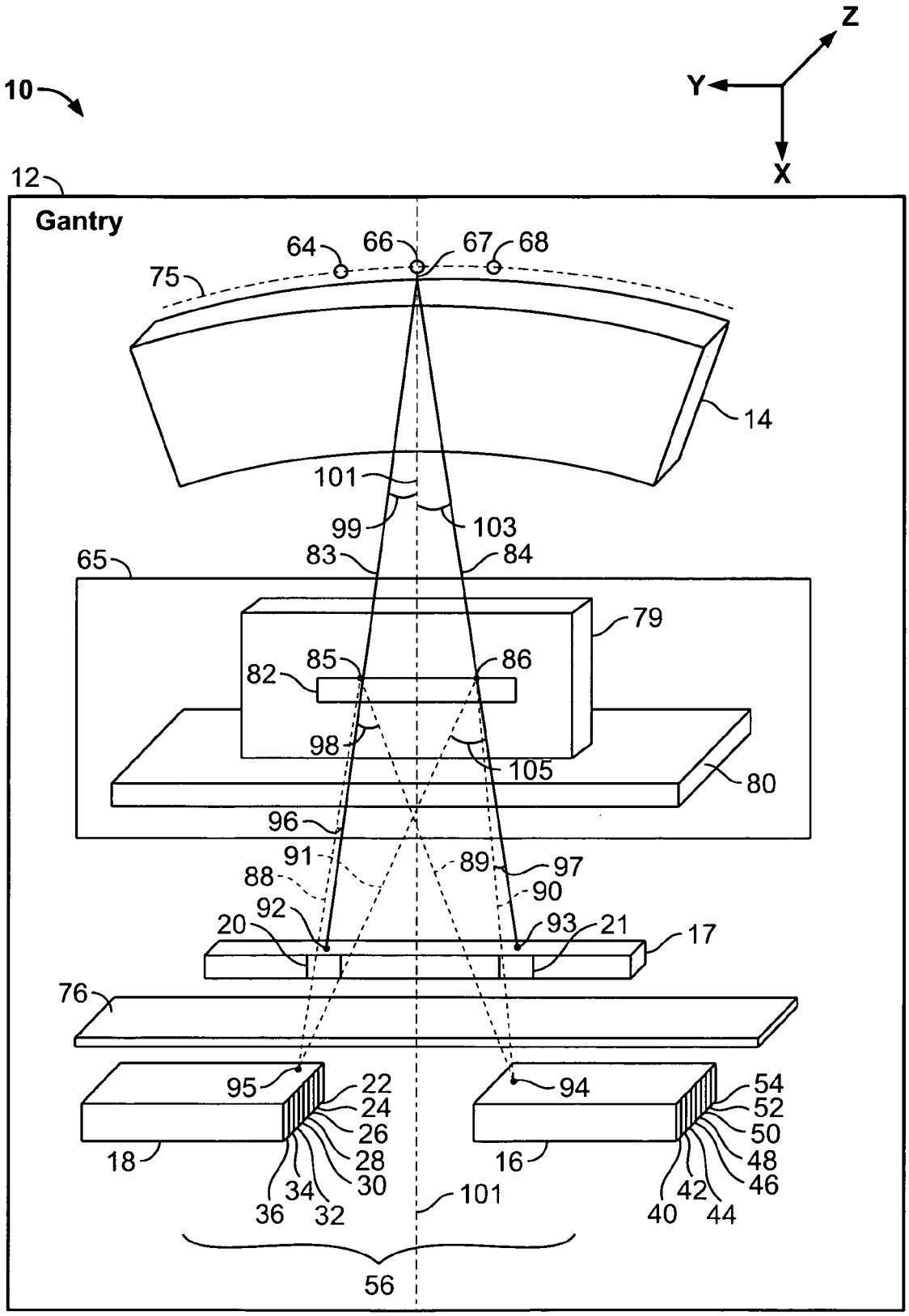
FIGS. 1-10 include embodiments of a method, a processor, and a system for tracking a focus of a beam.

FIG. 1 is an isometric view of an embodiment of a system 10 for measuring an X-ray diffraction profile. System 10 includes a gantry 12. Gantry 12 includes a primary collimator 14, which, in one embodiment, is a multi-focus primary collimator, a scatter detector 16, a transmission detector 17, a scatter detector 18, and a secondary collimator 76. Each scatter detector 16 and 18 is a segmented semiconductor detector.

Transmission detector 17 includes a plurality of detector elements, such as detector elements 20 and 21. Scatter detector 18 includes a plurality of detector cells or detector elements 22, 24, 26, 28, 30, 32, 34, and 36 for detecting coherent scatter. Scatter detector 16 includes a plurality of detector cells or detector elements 40, 42, 44, 46, 48, 50, 52, and 54 for detecting coherent scatter. Each scatter detector 16 and 18 includes any suitable number of detector elements, such as ranging from and including 5 to 1200 detector elements. For example, scatter detector 18 includes 5 detector elements in a z-direction parallel to a z-axis, and one detector element in a y-direction parallel to a y-axis. As another example, scatter detector 18 includes 20 detector elements in the y-direction, and 20 detector elements in the z-direction. As yet another example, scatter detector 18 includes 40 detector elements in the y-direction, and 30 detector elements in the z-direction. An x-axis, the y-axis, and the z-axis are located within an xyz co-ordinate system having an origin. The x-axis is perpendicular to the y-axis and the z-axis, the y-axis is perpendicular to the z-axis, and the x-axis is parallel to an x-direction. A number of detector elements within scatter detector 16 may be equal to a number of detector elements within scatter detector 18.

Scatter detector 16 is separate from scatter detector 18. For example, scatter detector 16 has a housing that is separate from a housing of scatter detector 18. As another example, scatter detectors 16 and 18 are separated from each other by a gap. As yet another example, a shortest distance 56 between a center of scatter detector 16 and a center of scatter detector 18 ranges from and including 40 millimeters (mm) to 200 mm. As another example, shortest distance 56 between a center of scatter detector 16 and a center of scatter detector 18 is 45 mm. As yet another example, shortest distance 56 between a center of scatter detector 16 and a center of scatter detector 18 is 125 mm. As still another example, shortest distance 56 between a center of scatter detector 16 and a center of scatter detector 18 is 195 mm. Scatter detector 16, scatter detector 18, and transmission detector 17 may be located in the same yz plane. The yz plane is formed by the y-axis and the z-axis. Each scatter detector 16 and scatter detector 18 may be separated from transmission detector 17 by a shortest distance ranging from and including 30 mm to 60 mm in the z-direction. As an example, each scatter detector 16 and scatter detector 18 is separated from transmission detector 17 by a shortest distance of 35 mm in the z-direction. As another example, each scatter detector 16 and scatter detector 18 is separated from transmission detector 17 by a shortest distance of 50 mm in the z-direction. As yet another example, each scatter detector 16 and scatter detector 18 is separated from transmission detector 17 by a shortest distance of 60 mm in the z-direction.

Gantry 12 further includes a plurality of X-ray sources 64, 66, and 68. X-ray sources 64, 66, and 68, and transmission detector 17 form an inverse single-pass multi-focus imaging system. X-ray sources 64, 66, and 68 have an inverse fan-beam geometry that includes a symmetric location of X-ray sources 64, 66, and 68 relative to the x-axis. X-ray sources 64, 66, and 68 are located parallel to and coincident with an arc 75. A center of transmission detector 17 is located at a center of a circle having arc 75. Each X-ray source 64, 66, and 68 is an X-ray source that includes a cathode and an anode. Alternatively, each X-ray source 64, 66, and 68 is an X-ray source that includes a cathode and all X-ray sources 64, 66, and 68 share a common anode.

An object 79 is placed on a support 80 between a set of X-ray sources 64, 66, and 68, and a set of scatter detectors 16 and 18. Object 79 and support 80 are located within an opening 65 of gantry 12. Examples of object 79 include a bag, a suitcase, a briefcase, a box, and an air cargo container. Examples of each X-ray source 64, 66, and 68 include a polychromatic X-ray source. Object 79 includes a substance 82. Examples of substance 82 include an organic explosive, an amorphous substance having a crystallinity of less than twenty five percent, a quasi-amorphous substance having a crystallinity at least equal to twenty-five percent and less than fifty percent, and a partially crystalline substance having a crystallinity at least equal to fifty percent and less than one-hundred percent, and a crystalline substance having a crystallinity of one-hundred percent. Examples of the amorphous, quasi-amorphous, and partially crystalline substances include a gel explosive, a slurry explosive, an explosive including ammonium nitrate, and a special nuclear material. Examples of the special nuclear material include plutonium and uranium. Examples of support 80 include a table and a conveyor belt. An example of each scatter detector 16 and 18 includes a segmented detector fabricated from Germanium.

X-ray source 66 emits an X-ray beam 67 in an energy range, which is dependent on a voltage applied by a power source to X-ray source 66. Primary collimator 14 generates two primary beams 83 and 84, such as pencil beams, after collimating X-ray beam 67 from X-ray source 66. Primary beams 83 and 84 pass through a plurality of points 85 and 86, respectively, on substance 82 within object 79 arranged on support 80 to generate scattered radiation 88, 89, 90, and 91. For example, primary beam 83 passes through point 85 to generate scattered radiation 88 and 89. As another example, primary beam 84 passes through point 86 to generate scattered radiation 90 and 91.

Secondary collimator 76 is located between support 80 and scatter detectors 16 and 18. Secondary collimator 76 includes a number of collimator elements, such as sheets, slits, plates, or laminations, to ensure that scattered radiation arriving at scatter detectors 16 and 18 have constant scatter angles with respect to primary beams 83 and 84 and that a position of scatter detectors 16 and 18 permits a depth in object 79 at which the scattered radiation originated to be determined. For example, the collimator elements of secondary collimator 76 are arranged parallel to a direction of scattered radiation 88 and of scattered radiation 90 to absorb scattered radiation that is not parallel to the direction of scattered radiation 88 and of scattered radiation 90.

The number of collimator elements in secondary collimator 76 is equal to or alternatively greater than a number of detector elements of scatter detectors 16 and/or 18. The collimator elements are arranged such that scattered radiation between neighboring collimator elements is incident on one of the detector elements. The collimator elements of scatter detectors 16 and 18 are made of a radiation-absorbing material, such as steel, copper, silver, or tungsten.

Transmission detector 17 is positioned underneath support 80, and configured to measure an intensity of primary beam 83 at a point 92 on transmission detector 17 and an intensity of primary beam 84 at a point 93 on transmission detector 17. Moreover, scatter detectors 16 and 18 that measure photon energies of scattered radiation are positioned underneath support 80 and configured to measure photon energies of scattered radiation received by scatter detectors 16 and 18. Each scatter detector 16 and 18 measures the X-ray photons within scattered radiation received by scatter detectors 16 and 18 in an energy-sensitive manner by outputting a plurality of electrical output signals linearly dependent on a plurality of energies of the X-ray photons detected from within the scattered radiation. Scatter detector 16 measures scattered radiation 90 received at a point 94 on scatter detector 16 and scatter detector 18 measures scattered radiation 88 received at a point 95 on scatter detector 18. An example of a shortest distance between points 85 and 95 includes a distance ranging from and including 900 mm to 1100 mm. Another example of a shortest distance between points 85 and 95 includes a distance of 925 mm. Yet another example of a shortest distance between points 85 and 95 includes a distance of 1000 mm. Another example of a shortest distance between points 85 and 95 includes a distance of 1095 mm. An example of a distance between points 95 and 92 includes a distance ranging from and including 25 mm to 80 mm. Yet another example of a distance between points 95 and 92 includes a distance of 30 mm. Another example of a distance between points 95 and 92 includes a distance of 50 mm. Yet another example of a distance between points 95 and 92 includes a distance of 75 mm.

Scatter detectors 16 and 18 detect scattered radiation to generate a plurality of electrical output signals. Scatter detector 16 detects scattered radiation 90 generated upon intersection of primary beam 84 with point 86. Moreover, scatter detector 16 detects at least a portion of scattered radiation 89 generated upon intersection of primary beam 83 with point 85. Scatter detector 18 detects scattered radiation 88 generated upon intersection of primary beam 83 with point 85. Moreover, scatter detector 18 detects at least a portion of scattered radiation 91 generated upon intersection of primary beam 84 with point 86. A scatter angle 96 formed between primary beam 83 and scattered radiation 88 is equal to a scatter angle 97 formed between primary beam 84 and scattered radiation 90. An example of each scatter angle 96 and 97 includes an angle ranging from and including 0.025 radians to 0.045 radians. As another example, each scatter angle 96 and 97 includes an angle of 0.03 radians. As yet another example, each scatter angle 96 and 97 includes an angle of 0.04 radians. As still another example, each scatter angle 96 and 97 includes an angle of 0.045 radians. An example of a scatter angle 98 formed between primary beam 83 and scattered radiation 89 ranges from and including 0.05 radians to 0.09 radians. An example of scatter angle 98 includes 0.05 radians. Another example of scatter angle 98 includes 0.07 radians. Yet another example of scatter angle 98 includes 0.09 radians. Moreover, an example of a scatter angle 105 formed between primary beam 84 and scattered radiation 91 ranges from and including 0.05 radians to 0.09 radians. An example of scatter angle 105 includes 0.05 radians. Another example of scatter angle 105 includes 0.07 radians. Yet another example of scatter angle 105 includes 0.09 radians.

Scatter angle 98 is at least two times greater than scatter angles 96 and/or 97 and scatter angle 105 is at least two times greater than scatter angles 96 and/or 97. An angle 99 formed by primary beam 83 with respect to a centerline 101 between scatter detectors 16 and 18 is equal to an angle 103 formed by primary beam 84 with respect to centerline 101.

In an alternative embodiment, system 10 includes additional scatter detectors other than scatter detectors 16 and 18. The additional scatter detectors are placed on a side of transmission detector 17 that includes scatter detectors 16 and 18. Moreover, the additional scatter detectors are the same as scatter detectors 16 and 18. For example, any one of the additional scatter detectors has the same number of detector elements as that of scatter detectors 16 and/or 18. In yet another alternative embodiment, system 10 does not include scatter detector 16. In still another alternative embodiment, a single-focus primary collimator is used instead of primary collimator 14 and the single-focus primary collimator may generate one of primary beams 83 and 84. In another alternative embodiment, gantry 12 includes any number, such as one, two, four, five, or ten X-ray sources. In another alternative embodiment, primary collimator 14 collimates X-ray beam 67 received from X-ray source 66 to generate a plurality, such as three or four, primary beams.

Figure 2:
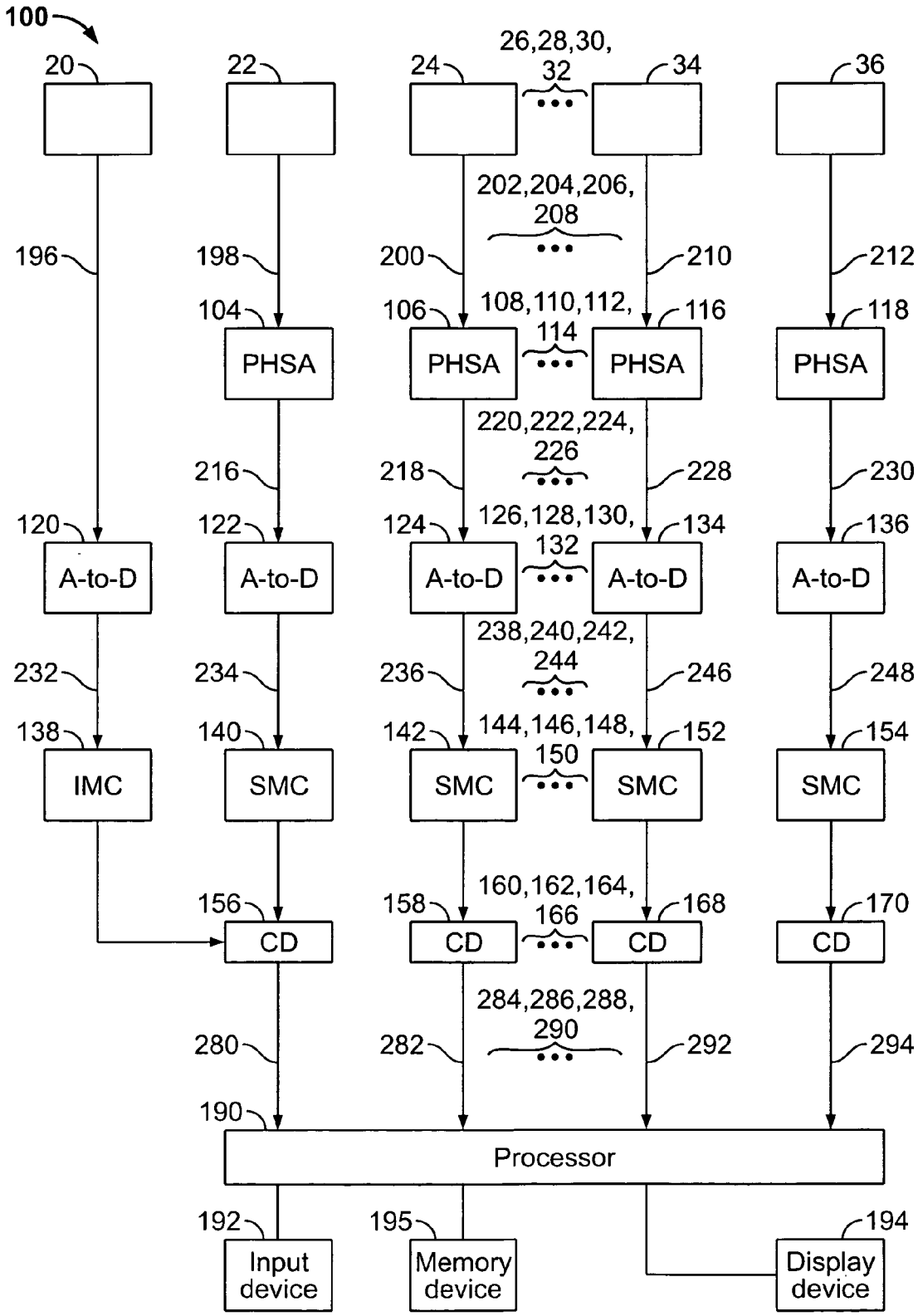

FIG. 2 is block diagram of an embodiment of a system 100 for measuring an X-ray diffraction profile. System 100 includes detector element 20 of transmission detector 17, scatter detector elements 22, 24, 26, 28, 30, 32, 34, and 36, a plurality of pulse-height shaper amplifiers (PHSA) 104, 106, 108, 110, 112, 114, 116, and 118, a plurality of analog-to-digital (A-to-D) converters 120, 122, 124, 126, 128, 130, 132, 134, and 136, an intensity memory circuit (IMC) 138, a plurality of spectrum memory circuits (SMCs) 140, 142, 144, 146, 148, 150, 152, and 154 allowing pulse height spectra to be acquired, a plurality of correction devices (CDs) 156, 158, 160, 162, 164, 166, 168, and 170, a processor 190, an input device 192, a display device 194, and a memory device 195. As used herein, the term processor is not limited to just those integrated circuits referred to in the art as a processor, but broadly refers to a computer, a microcontroller, a microcomputer, a programmable logic controller, an application specific integrated circuit, and any other programmable circuit. The computer may include a device, such as, a floppy disk drive or CD-ROM drive, for reading data including the method for tracking a focus of a beam from a computer-readable medium, such as a floppy disk, a compact disc—read only memory (CD-ROM), a magneto-optical disk (MOD), and/or a digital versatile disc (DVD). In an alternative embodiment, processor 190 executes instructions stored in firmware. Examples of display device 194 include a liquid crystal display (LCD) and a cathode ray tube (CRT). Examples of input device 192 include a mouse and a keyboard. Examples of memory device 195 include a random access memory (RAM) and a read-only memory (ROM). An example of each correction device 156, 158, 160, 162, 164, 166, 168, and 170 include a divider circuit. Each circuit 138, 140, 142, 144, 146, 148, 150, 152, and 154 includes an adder and a memory device, such as a RAM or a ROM.

Detector element 20 is coupled to analog-to-digital converter 120, and detector elements 22, 24, 26, 28, 30, 32, 34, and 36 are coupled to pulse-height shaper amplifiers 104, 106, 108, 110, 112, 114, 116, and 118, respectively. Detector element 20 generates an electrical output signal 196 by detecting primary beam 83 and detector elements 22, 24, 26, 28, 30, 32, 34, and 36 generate a plurality of electrical output signals 198, 200, 202, 204, 206, 208, 210, and 212 by detecting scattered radiation. For example, detector element 22 generates electrical output signal 198 for each scattered X-ray photon incident on detector element 22. Each pulse-height shaper amplifier amplifies an electrical output signal received from a corresponding detector element. For example, pulse-height shaper amplifier 104 amplifies electrical output signal 198 and pulse-height shaper amplifier 106 amplifies electrical output signal 200. Pulse-height shaper amplifiers 104, 106, 108, 110, 112, 114, 116, and 118 have a gain factor determined by processor 190.

An amplitude of an electrical output signal output from a detector element is proportional to an integrated energy of X-ray quanta that is detected by the detector element to generate the electrical output signal. For example, an amplitude of electrical output signal 196 is proportional to an integrated energy of X-ray quanta in primary beam 83 detected by detector element 20. As another example, an amplitude of electrical output signal 198 is proportional to an integrated energy of X-ray quanta within scattered radiation that is detected by detector element 22.

A pulse-height shaper amplifier generates an amplified output signal by amplifying an electrical output signal generated from a detector element. For example, pulse-height shaper amplifier 104 generates an amplified output signal 216 by amplifying electrical output signal 198 and pulse-height shaper amplifier 106 generates an amplified output signal 218 by amplifying electrical output signal 200. Similarly, a plurality of amplified output signals 220, 222, 224, 226, 228, and 230 are generated. An analog-to-digital converter converts an output signal from an analog form to a digital form to generate a digital output signal. For example, analog-to-digital converter 120 converts electrical output signal 196 from an analog form to a digital format to generate a digital output signal 232, and analog-to-digital converter 122 converts amplified output signal 216 from an analog form to a digital format to generate a digital output signal 234. Similarly, a plurality of digital output signals 236, 238, 240, 242, 244, 246, and 248 are generated by analog-to-digital converters 124, 126, 128, 130, 132, 134, and 136, respectively. A digital value of a digital output signal generated by an analog-to-digital converter represents an amplitude of energy of an amplified output signal. For example, a digital value of digital output signal 234 output by analog-to-digital converter 122 is a value of an amplitude of amplified output signal 216. Each digital output signal is generated by integrating a charge liberated by a plurality of X-ray quantums, such as X-ray photons.

An adder of a spectrum memory circuit or an intensity memory circuit adds a number of pulses in a digital output signal. For example, when analog-to-digital converter 122 converts a pulse of amplified output signal 216 into digital output signal 234 to determine an amplitude of the pulse of amplified output signal 216, an adder within spectrum memory circuit 140 increments, by one, a value within a memory device of spectrum memory circuit 140. As another example, when analog-to-digital converter 120 converts a pulse of electrical output signal 196 into digital output signal 232 to determine an amplitude of the pulse of electrical output signal 196, an adder within intensity memory circuit 138 increments, by one, a value within a memory device of intensity memory circuit 138. Accordingly, at an end of an X-ray examination of substance 82, a memory device within a spectrum memory circuit or an intensity memory circuit stores a number of X-ray quanta detected by a detector element. For example, a memory device within spectrum memory circuit 142 stores a number of X-ray photons detected by detector element 24 and each of the X-ray photons has an amplitude of energy or alternatively an amplitude of intensity that is determined by analog-to-digital converter 124. As another example, a memory device within intensity memory circuit 138 stores a number of X-ray photons detected by detector element 20 and each of the X-ray photons has an amplitude of energy or alternatively an amplitude of intensity that is determined by analog-to-digital converter 120.

A correction device receives a number of X-ray quanta that have a range of energies and are stored within a memory device of one of spectrum memory circuits 140, 142, 144, 146, 148, 150, 152, and 154, and divides the number of X-ray quanta by a number of X-ray quanta having the range of energies received from a memory device of intensity memory circuit 138. For example, correction device 156 receives a number of X-ray photons having a range of energies from a memory device of spectrum memory circuit 140, and divides the number of X-ray photons by a number of X-ray photons having the range received from a memory device of intensity memory circuit 138. Each correction device outputs a correction output signal that represents a range of energies within X-ray quanta received by a detector element. For example, correction device 156 outputs a correction output signal 280 representing an energy spectrum or alternatively an intensity spectrum within X-ray quanta detected by detector element 22. As another example, correction device 158 outputs correction output signal 282 representing an energy spectrum within X-ray quanta detector element 24. Similarly, a plurality of correction output signals 284, 286, 288, 290, 292, and 294 are generated by correction devices 160, 162, 164, 166, 168, and 170, respectively.

It is noted that a number of pulse-height shaper amplifiers 104, 106, 108, 110, 112, 114, 116, and 118 changes with a number of scatter detector elements 22, 24, 26, 28, 30, 32, 34, and 36. For example, five pulse-height shaper amplifiers are used for amplifying signals received from five corresponding scatter detector elements. As another example, four pulse-height shaper amplifiers are used for amplifying signals received from corresponding four scatter detector elements. Similarly, a number of analog-to-digital converters 120, 122, 124, 126, 128, 130, 132, 134, and 136 changes with a number of detector elements 20, 22, 24, 26, 28, 30, 32, 34, and 36 and a number of spectrum memory circuits 138, 140, 142, 144, 146, 148, 150, 152, and 154 changes with the number of detector elements 20, 22, 24, 26, 28, 30, 32, 34, and 36.

Figure 3:
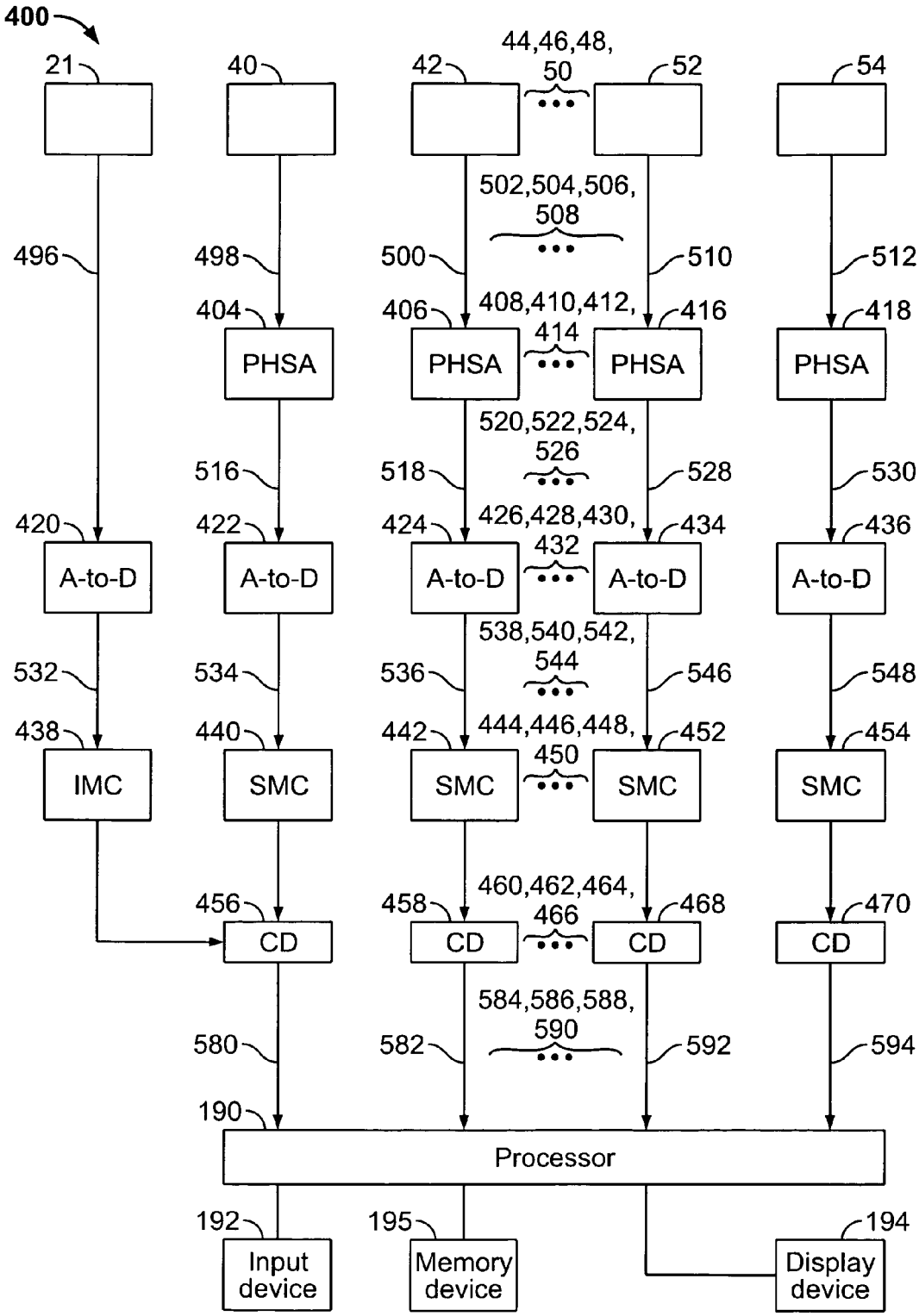

FIG. 3 is a block diagram of an embodiment of a system 400 for measuring an X-ray diffraction profile. System 400 includes detector element 21 of transmission detector 17, scatter detector elements 40, 42, 44, 46, 48, 50, 52, and 54, a plurality of pulse-height shaper amplifiers (PHSA) 404, 406, 408, 410, 412, 414, 416, and 418, a plurality of analog-to-digital (A-to-D) converters 420, 422, 424, 426, 428, 430, 432, 434, and 436, an intensity memory circuit 438, a plurality of spectrum memory circuits (SMCs) 440, 442, 444, 446, 448, 450, 452, and 454 allowing pulse height spectra to be acquired, a plurality of correction devices (CDs) 456, 458, 460, 462, 464, 466, 468, and 470, processor 190, input device 192, display device 194, and memory device 195. An example of each correction device 456, 458, 460, 462, 464, 466, 468, and 470 include a divider circuit. Each circuit 438, 440, 442, 444, 446, 448, 450, 452, and 454 includes an adder and a memory device, such as a RAM or a ROM.

Transmission detector element 21 generates an electrical output signal 496 by detecting primary beam 84 and scatter detector elements 40, 42, 44, 46, 48, 50, 52, and 54 generate a plurality of electrical output signals 498, 500, 502, 504, 506, 508, 510, and 512 by detecting scattered radiation. For example, transmission detector element 21 generates electrical output signal 496 for X-ray photons incident on transmission detector element 21. Scatter detector elements 40, 42, 44, 46, 48, 50, 52, and 54 are coupled to pulse-height shaper amplifiers 404, 406, 408, 410, 412, 414, 416, and 418, respectively. Each pulse-height shaped amplifier amplifies an electrical output signal received from a corresponding detector element. For example, pulse-height shaper amplifier 404 amplifies electrical output signal 498. Pulse-height shaper amplifiers 404, 406, 408, 410, 412, 414, 416, and 418 have a gain factor determined by processor 190.

An amplitude of an electrical output signal output from a detector element is proportional to an integrated energy of X-ray quanta that is detected by the detector element to generate the electrical output signal. For example, an amplitude of electrical output signal 496 is proportional to an integrated energy of X-ray quanta in primary beam 84 detected by detector element 21. As another example, an amplitude of electrical output signal 498 is proportional to an integrated energy of X-ray quanta within scattered radiation that is detected by detector element 40.

A pulse-height shaper amplifier generates an amplified output signal by amplifying an electrical output signal generated from a detector element. For example, pulse-height shaper amplifier 404 generates an amplified output signal 516 by amplifying electrical output signal 498 and pulse-height shaper amplifier 406 generates an amplified output signal 518 by amplifying electrical output signal 500. Similarly, a plurality of amplified output signals 520, 522, 524, 526, 528, and 530 are generated. An analog-to-digital converter converts an output signal from an analog form to a digital form to generate a digital output signal. For example, analog-to-digital converter 420 converts electrical output signal 496 from an analog form to a digital format to generate a digital output signal 532 and analog-to-digital converter 422 converts amplified output signal 516 from an analog form to a digital format to generate a digital output signal 534. Similarly, a plurality of digital output signals 536, 538, 540, 542, 544, 546, and 548 are generated by analog-to-digital converters 424, 426, 428, 430, 432, 434, and 436, respectively. A digital value of a digital output signal generated by an analog-to-digital converter represents an amplitude of energy or alternatively an amplitude of intensity of a pulse of an amplified output signal. For example, a digital value of digital output signal 534 output by analog-to-digital converter 422 is a value of an amplitude of a pulse of amplified output signal 516.

An adder of a spectrum memory circuit or an intensity memory circuit adds a number of pulses in a digital output signal. For example, when analog-to-digital converter 422 converts a pulse of amplified output signal 516 into digital output signal 534 to determine an amplitude of the pulse of amplified output signal 516, an adder within spectrum memory circuit 440 increments, by one, a value within a memory device of spectrum memory circuit 440. Accordingly, at an end of an X-ray examination of substance 82, a memory device within a spectrum memory circuit or an intensity memory circuit stores a number of X-ray quanta detected by a detector element. For example, a memory device within spectrum memory circuit 442 stores a number of X-ray photons detected by detector element 42 and each of the X-ray photons has an amplitude of energy that is determined by analog-to-digital converter 424.

A correction device receives a number of X-ray quanta that have a range of energies and are stored within a memory device of one of spectrum memory circuits 440, 442, 444, 446, 448, 450, 452, and 454, and divides the number of X-ray quanta by a number of X-ray quanta having the range of energies received from a memory device of intensity memory circuit 438. For example, correction device 456 receives a number of X-ray photons having a range of energies from a memory device of spectrum memory circuit 440, and divides the number of X-ray photons by a number of X-ray photons having the range received from a memory device of intensity memory circuit 438. Each correction device outputs a correction output signal that represents a range of energies within X-ray quanta received by a corresponding detector element. For example, correction device 456 outputs a correction output signal 580 representing an energy spectrum, or alternatively an intensity spectrum within X-ray quanta detected by detector element 40. As another example, correction device 458 outputs correction output signal 582 representing an energy spectrum within X-ray quanta detected by detector element 42. Similarly, a plurality of correction output signals 584, 586, 588, 590, 592, and 594 are generated by correction devices 460, 462, 464, 466, 468, and 470, respectively.

Processor 190 receives correction output signals 280, 282, 284, 286, 288, 290, 292, 294, 580, 582, 584, 586, 588, 590, 592, and 594 to generate a momentum transfer x, measured in inverse nanometers ($nm^{-1}$), from an energy spectrum r(E) of energy E of X-ray quanta within scattered radiation detected by scatter detectors 16 and 18 (shown in FIG. 1). Processor 190 generates the momentum transfer x by applying $$x=(E/hc)\sin(\theta/2) \quad \text{Eq. (1)}$$

where c is a speed of light, h is Planck's constant, and θ represents a constant scatter angle of X-ray quanta of scattered radiation detected by scatter detectors 16 and 18. Examples of θ include scatter angles 96 and 97 (shown in FIG. 1). Processor 190 relates the energy E to the momentum transfer x by equation (1). Mechanical dimensions of secondary collimator 76 (shown in FIG. 1) defines the scatter angle θ. The secondary collimator 76 restricts scattered radiation that does not have the scatter angle θ. Processor 190 receives the scatter angle θ from a user, such as a human being, via input device 192. Processor 190 generates a diffraction profile of substance 82 (shown in FIG. 1) by calculating a number of scatter X-ray photons that are detected by scatter detectors 16 and 18 and by plotting the number of scatter X-ray photons versus the momentum transfer x.

It is noted that a number of pulse-height shaper amplifiers 404, 406, 408, 410, 412, 414, 416, and 418 changes with a number of scatter detector elements 40, 42, 44, 46, 48, 50, 52, and 54. For example, five pulse-height shaper amplifiers are used for amplifying signals received from five corresponding scatter detector elements. As another example, four pulse-height shaper amplifiers are used for amplifying signals received from four corresponding scatter detector elements. Similarly, a number of analog-to-digital converters 420, 422, 424, 426, 428, 430, 432, 434, and 436 changes with a number of detector elements 21, 40, 42, 44, 46, 48, 50, 52, and 54, and a number of spectrum memory circuits 438, 440, 442, 444, 446, 448, 450, 452, and 454 changes with the number of detector elements 21, 40, 42, 44, 46, 48, 50, 52, and 54.

Figure 4:
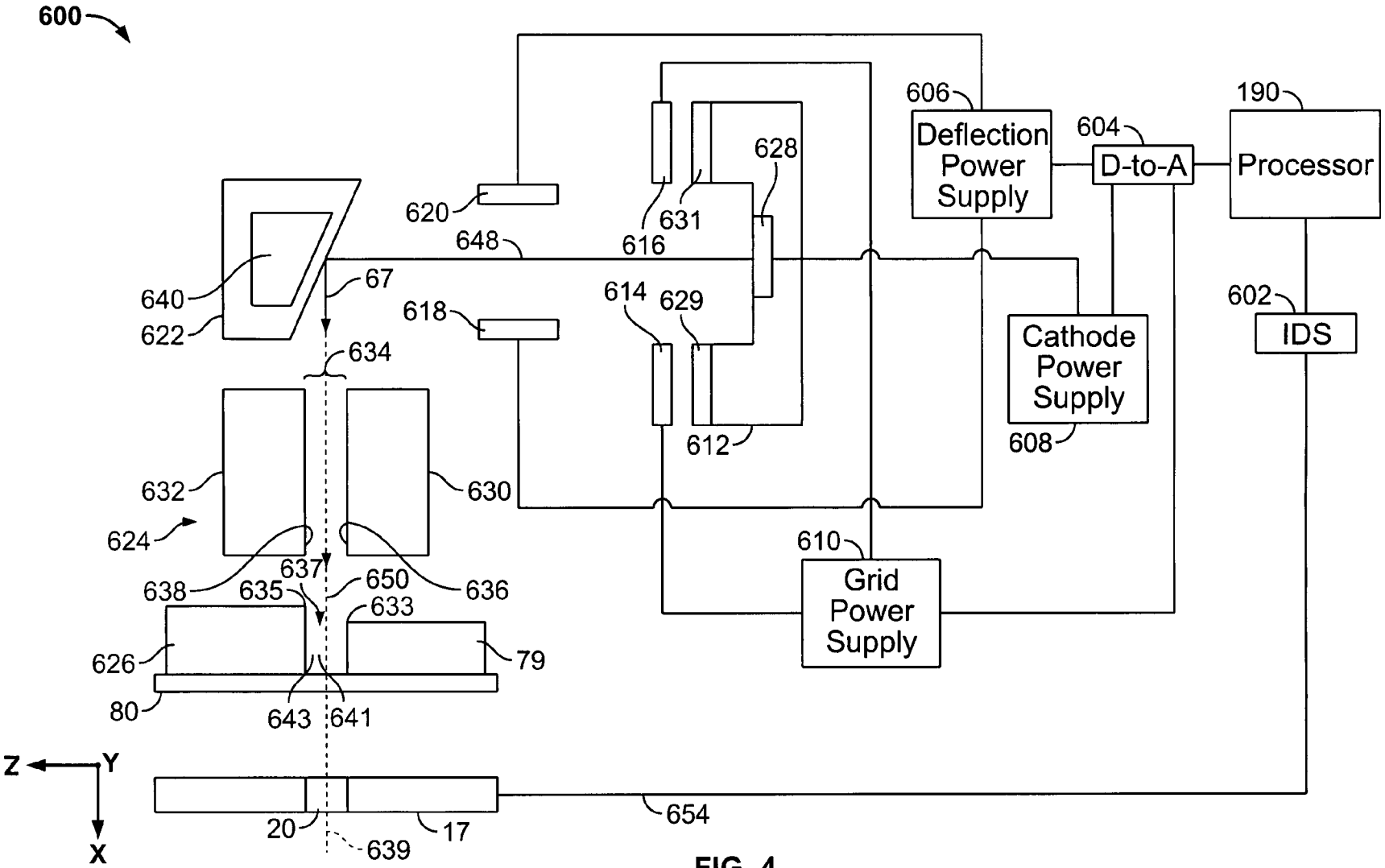

FIG. 4 is a block diagram of an embodiment of a system 600 for tracking a focus of a beam. System 600 includes processor 190, an intensity determination system (IDS) 602, a digital-to-analog converter (D-to-A) 604, a deflection power supply 606, a cathode power supply 608, a grid power supply 610, a cathode 612, a plurality of grid electrodes 614 and 616, a plurality of deflection electrodes 618 and 620, and an anode 622, a primary collimator 624, an object 626, object 79, transmission detector 17, a filament 628, and a plurality of insulators 629 and 631. Insulators 629 and 631 are attached to cathode 612 and are made of an insulator material, such as glass, mica, or ceramic. Object 79 has an edge 633 and object 626 has an edge 635. Edge 633 of object 79 is an end point of object 79 along the z-axis. Edge 635 of object 626 is an end point of object 626 along the z-axis. A space 637 is formed between edges 633 and 635. Space 637 includes a plurality of points 641 and 643. Edges 633 and 635 form end-points of space 637. A center axis 639 passes through a centroid of primary collimator 624 and is parallel to the x-axis. Cathode 612, grid electrodes 614 and 616, deflection electrodes 618 and 620, and anode 622 are located in any of x-ray sources, such as x-ray source 64 or x-ray source 66, of system 10. Examples of object 626 include a bag, a suitcase, a briefcase, a box, and an air cargo container.

Primary collimator 624 includes a plurality of collimator blocks 630 and 632, and primary collimator 624 has an aperture 634 having a perpendicular distance, parallel to the z-axis between collimator blocks 630 and 632, ranging from and including 100 micrometers (μm) to 300 μm. Collimator block 630 includes a surface 636 and collimator block 632 includes a surface 638. Surface 636 faces surface 638. Each collimator block 630 and 632 has a depth in the y-direction. Moreover, primary collimator 624 has a length, parallel to the x-axis ranging from and including 200 mm to 700 mm, and a width, parallel to the z-axis, ranging from and including 5 mm to 50 mm. Anode 622 includes a coolant channel 640 that is enclosed by anode 622 and includes a coolant that cools anode 622.

Processor 190 generates a cathode command signal that is sent to digital-to-analog converter 604. Digital-to-analog converter 604 receives the cathode command signal from processor 190 and converts the signal from a digital format to an analog format to generate a cathode analog signal. Cathode power supply 608 receives the cathode analog signal and generates a cathode supply signal that is supplied to filament 628. Filament 628 is heated upon receiving the cathode supply signal from cathode power supply 608 and heat generated by filament 628 heats cathode 612. Cathode 612 generates an electron beam 648 upon receiving heat from filament 628.

Processor 190 generates a grid command signal that is provided to digital-to-analog converter 604. Upon receiving the grid command signal from processor 190, digital-to-analog converter 604 converts the grid command signal from a digital format to an analog format to generate a grid analog signal, which is a pulsed signal. Upon receiving the grid analog signal, grid power supply 610 generates a pulsed grid supply signal having a voltage ranging from and including 0 kilovolts (kV) to −2 kV that is applied to grid electrodes 614 and 616. Cathode 612 pulses generation of electron beam 648 when the grid supply signal is applied to grid electrodes 614 and 616. For example, when the grid supply signal applied to grid electrodes 614 and 616 has a voltage of −2 kV, a voltage applied via the cathode supply signal to cathode 612 is canceled and cathode 612 does not generate electron beam 648. In this example, when the grid supply signal has a voltage of 0 kV, a voltage applied via the cathode supply signal to cathode 612 is not canceled, and cathode 612 generates electron beam 648. Insulators 629 and 631 insulate grid electrodes 614 and 616 from cathode 612 to facilitate providing and maintaining the grid voltage of grid electrodes 614 and 616.

Upon receiving electron beam 648 from cathode 612, anode 622 generates x-ray beam 67. Primary collimator 624 collimates x-ray beam 67 to output a collimated beam 650. Primary collimator 624 accepts a portion of x-ray beam 67 within an acceptance window, ranging from and including an angular acceptance of 0.0001 radians to 0.0005 radians, measured with respect to the z-axis. A width, along the z-axis, of aperture 634 defines the acceptance window. Collimated beam 650 passes through object 79 to generate a transmitted beam $C_1$ and scattered radiation. Transmitted beam $C_1$ may be deflected in any of a direction parallel to the x axis, y axis, or z axis. Detector element 20 of transmission detector 17 detects transmitted beam $C_1$ to output electrical output signal 654.

Figure 5:
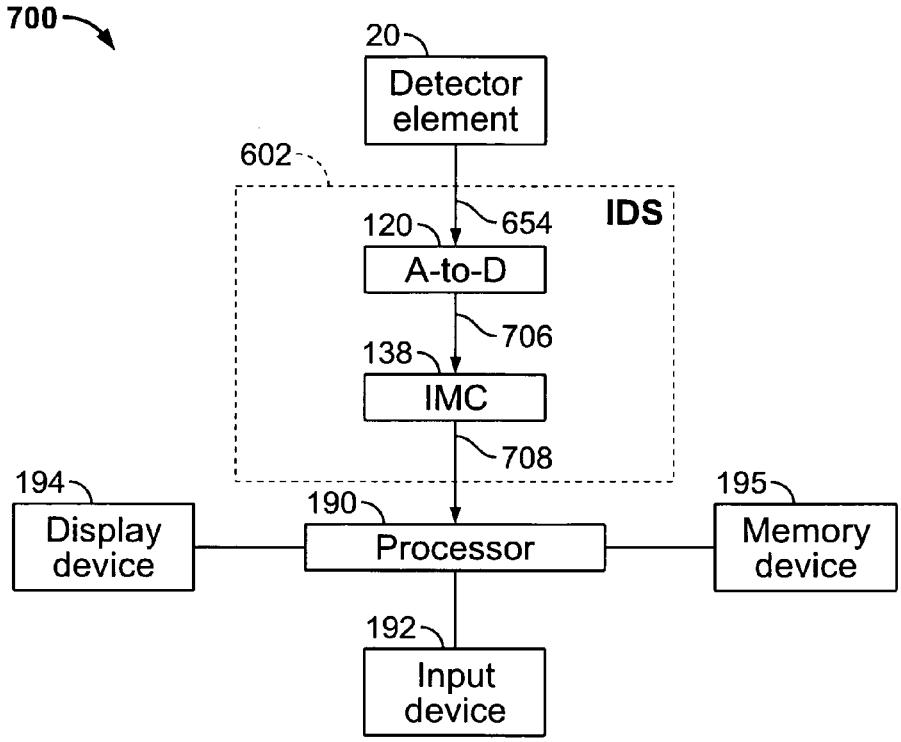

FIG. 5 is a block diagram of an embodiment of a system 700 for tracking a focus of a beam and FIGS. 6-10 collectively show a flowchart of an embodiment of a method for tracking a focus of a beam. System 700 includes detector element 20 of transmission detector 17, IDS 602, processor 190, input device 192, display device 194, and memory device 195. IDS 602 includes analog-to-digital converter 120, and intensity memory circuit 138.

Detector element 20 is coupled to analog-to-digital converter 120. Detector element 20 generates electrical output signal 654. An amplitude of electrical output signal 654 output from detector element 20 is proportional to an integrated energy of X-ray quanta that is detected by detector element 20 to generate electrical output signal 654. For example, an amplitude of electrical output signal 654 is proportional to an integrated energy of an X-ray quanta in transmitted beam $C_1$ detected by detector element 20.

Analog-to-digital converter 120 converts electrical output signal 654 from an analog format to a digital format to generate a digital output signal 706. A digital value of digital output signal 706 output by analog-to-digital converter 120 is a value of an amplitude of electrical output signal 654.

Figure 6:
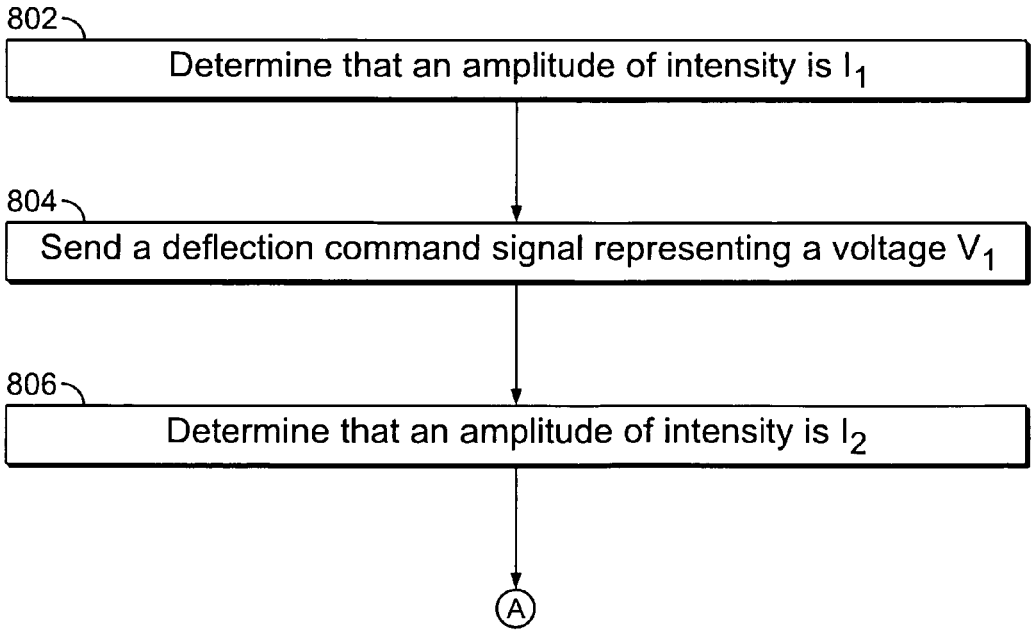
Figure 7:
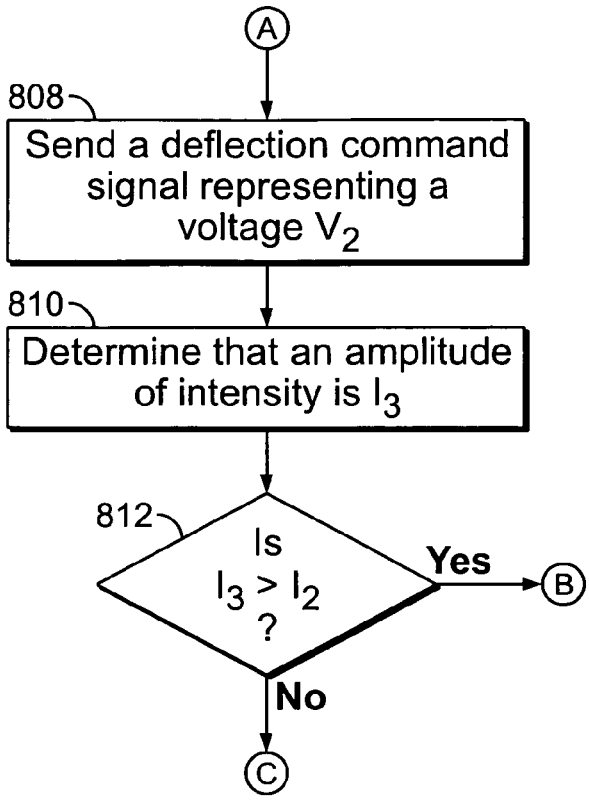
Figure 8:
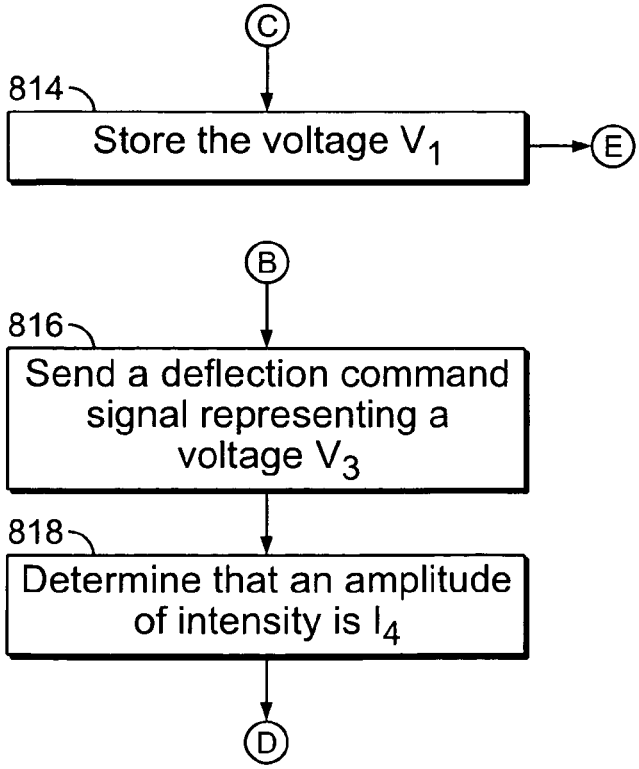
Figure 9:
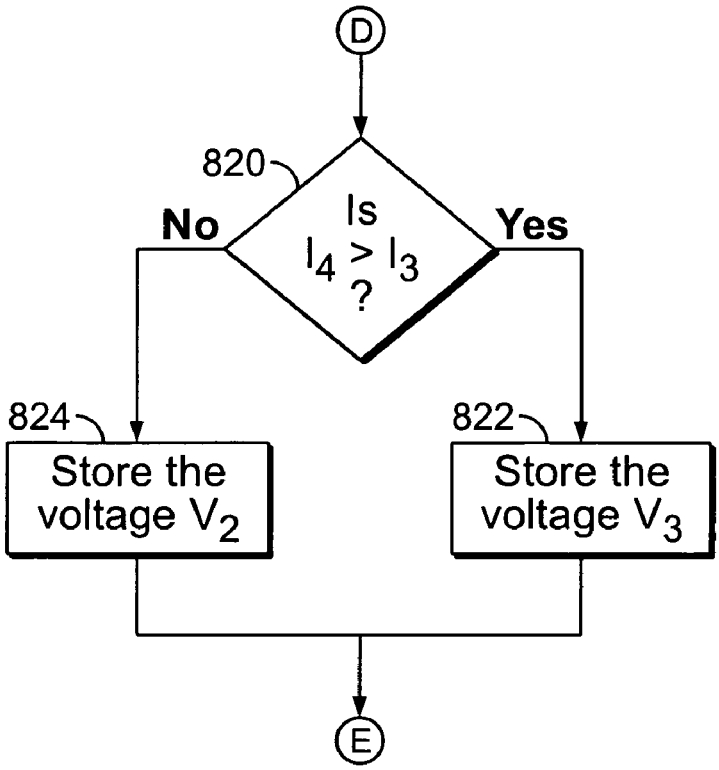
Figure 10:
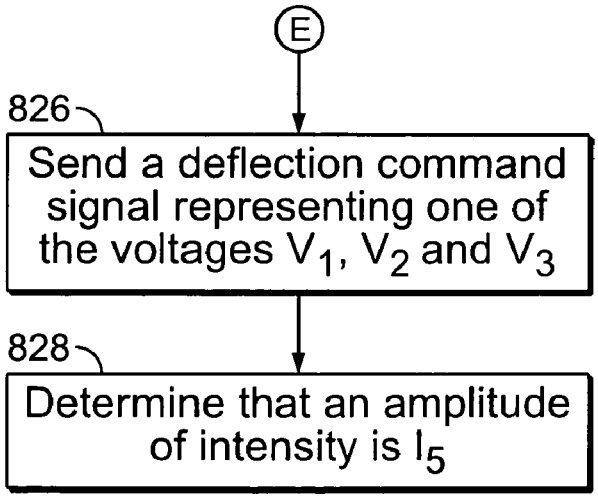

Intensity memory circuit 138 includes an adder (not shown) that adds a number of pulses in a digital output signal. For example, when analog-to-digital converter 120 converts a pulse of electrical output signal 654 into digital output signal 706 to determine an amplitude of the pulse of electrical output signal 654, the adder within intensity memory circuit 138 increments, by one, a value within a memory device (not shown) of intensity memory circuit 138. Accordingly, at an end of an X-ray examination of object 79, the memory device within intensity memory circuit 138 stores a number of X-ray quanta detected by a detector element. For example, the memory device within intensity memory circuit 138 stores a number of X-ray photons detected by detector element 20 and each of the X-ray photons has an amplitude of energy or, alternatively, an amplitude of intensity $I_1$ that is generated by analog-to-digital converter 120. Intensity memory circuit 138 outputs an intensity memory circuit output signal 708 to processor 190. As shown in FIG. 6, processor 190 determines 802 that an amplitude of intensity of intensity memory circuit output signal 708 is $I_1$.

Referring further to FIGS. 6-10, when support 80 moves in a direction opposite to the z-direction, center axis 639 passes edge 633 of object 79, and center axis 639 is at point 641 (shown in FIG. 4). With center axis 639 at point 641, processor 190 sends 804 a deflection command signal representing a voltage $V_1$ to digital-to-analog converter 604. A user selects a key on input device 192 upon determining that center axis 639 is at point 641. Upon selection of a key on input device 192, processor 190 sends 804 the deflection command signal representing the voltage $V_1$. Digital-to-analog converter 604 converts the deflection command signal, representing the voltage $V_1$, from a digital format into an analog format to output a deflection digital signal. Upon receiving the deflection digital signal representing the voltage $V_1$, deflection power supply 606 generates a deflection supply signal having the voltage $V_1$ that is applied to deflection electrodes 618 and 620. Upon receiving the voltage $V_1$, an anode position of electron beam 648 on anode 622 changes in the x-direction in comparison to an anode position used to generate the transmitted beam $C_1$, and a transmitted beam $C_2$ is incident on detector element 20 instead of the transmitted beam $C_1$.

Detector element 20 detects the transmitted beam $C_2$. Transmitted beam $C_2$ may be deflected parallel to at least one of the x axis, y axis, and z axis. As an example, a focus of transmitted beam $C_2$ is deflected at a plurality of distances, such as ranging from 0 mm to 10 mm, along anode 622 in the x-direction.

Intensity memory circuit 138 (shown in FIG. 5) outputs an intensity memory circuit output signal of an amplitude of intensity $I_2$ based on the transmitted beam $C_2$ in the same manner as intensity memory circuit output signal 708 is generated from the transmitted beam $C_1$. Processor 190 determines 806 that an amplitude of intensity of the intensity memory circuit signal generated based on the transmitted beam $C_2$ is $I_2$.

With center axis 639 at point 641, processor 190 further sends 808 a deflection command signal, representing a voltage $V_2$ greater than the voltage $V_1$, to digital-to-analog converter 604. A user controls support 80 via a motor and processor 190 that controls the motor to position point 641 at center axis 639. Digital-to-analog converter 604 converts the deflection command signal representing a voltage $V_2$ from a digital format into an analog format to output a deflection digital signal. Upon receiving the deflection digital signal representing the voltage $V_2$, deflection power supply 606 generates a deflection supply signal having the voltage $V_2$ that is applied to deflection electrodes 618 and 620. Upon receiving the voltage $V_2$, an anode position of electron beam 648 at anode 622 changes in the x-direction in comparison to an anode position used to generate the transmitted beam $C_2$, and a transmitted beam $C_3$ is incident on detector element 20 instead of transmitted beam $C_2$.

Intensity memory circuit 138 (shown in FIG. 5) outputs an intensity memory circuit output signal of an amplitude of intensity $I_3$ based on the transmitted beam $C_3$ in the same manner intensity memory circuit output signal 708 is generated from the transmitted beam $C_1$. Processor 190 determines 810 that an amplitude of the intensity of an intensity memory circuit output signal generated based on the transmitted beam $C_3$ is $I_3$ and determines 812 whether the intensity $I_3$ is greater than the intensity $I_2$.

With center axis 639 at point 641, upon determining 812 that the intensity $I_3$ is not greater than the intensity $I_2$, processor 190 commands memory device 195 to store 814 the voltage $V_1$ as corresponding to the intensity $I_2$ within a table in memory device 195 and does not command memory device 195 to store the voltage $V_2$. On the other hand, with center axis 639 at point 641, upon determining 812 that the intensity $I_3$ is greater than the intensity $I_2$, processor 190 sends 816 a deflection command signal, representing a voltage $V_3$ greater than the voltage $V_2$, to digital-to-analog converter 604. Digital-to-analog converter 604 converts the deflection command signal representing the voltage $V_3$ from a digital format into an analog format to output a deflection digital signal. Upon receiving the deflection digital signal representing the voltage $V_3$, deflection power supply 606 generates a deflection supply signal having the voltage $V_3$ that is applied to deflection electrodes 618 and 620. Upon receiving the voltage $V_3$, an anode position of electron beam 648 at anode 622 changes in the x-direction in comparison to an anode position used to generate the transmitted beam $C_3$, and a transmitted beam $C_4$ is incident on detector element 20 instead of transmitted beam $C_3$.

Intensity memory circuit 138 (shown in FIG. 5) outputs an intensity memory circuit output signal of an amplitude of intensity $I_4$ based on the transmitted beam $C_4$ in the same manner as intensity memory circuit output signal 708 is generated from the transmitted beam $C_1$. Processor 190 determines 818 that the intensity of a intensity memory circuit output signal generated based on the transmitted beam $C_4$ is $I_4$ and determines 820 whether the intensity $I_4$ is greater than the intensity $I_3$.

With center axis 639 at point 641, upon determining 820 that the intensity $I_4$ is greater than the intensity $I_3$, processor 190 commands memory device 195 to store 822 the voltage $V_3$ as corresponding to the intensity $I_4$ within the table in the memory device 195 and does not command memory device 195 to store the voltage $V_2$. On the other hand, with center axis 639 at point 641, upon determining 820 that the intensity $I_4$ is not greater than the intensity $I_3$, processor 190 commands memory device 195 to store 824 the voltage $V_2$ as corresponding to the intensity $I_3$ within the table in memory device 195 and does not command memory device 195 to store the voltage $V_3$.

As an object (not shown), other than object 79 and object 626, is scanned within system 600, processor 190 sends 826 a deflection command signal, representing one of voltages $V_1$, $V_2$, and $V_3$ stored within memory device 195, to digital-to-analog converter 604. When the other object is scanned, center axis 639 passes through the other object and not through space 637. Digital-to-analog converter 604 converts the deflection command signal, representing voltage $V_1$, $V_2$, or $V_3$, from a digital format into an analog format to output a deflection digital signal. Upon receiving the deflection digital signal representing voltage $V_1$, $V_2$, or $V_3$, deflection power supply 606 generates a deflection supply signal having the one of voltages $V_1$, $V_2$, and $V_3$ that is applied to deflection electrodes 618 and 620. Upon receiving the one of voltages $V_1$, $V_2$, and $V_3$, an anode position of electron beam 648 at anode 622 in the x-direction changes in the x-direction in comparison to an anode position used to generate the transmitted beam $C_1$, and a transmitted beam $C_5$ is incident on detector element 20 instead of the transmitted beam $C_1$.

Intensity memory circuit 138 (shown in FIG. 5) outputs an intensity memory circuit output signal of an amplitude of intensity $I_5$ based on the transmitted beam $C_5$ in the same manner as intensity memory circuit output signal 708 is generated from the transmitted beam $C_1$. Processor 190 determines 828 that the intensity of a intensity memory circuit output signal generated based on the transmitted beam $C_5$ is $I_5$. The intensity $I_5$ is a maximum intensity that is generated compared to intensities generated if the remaining of the voltages $V_1$, $V_2$, and $V_3$, other than the voltage $V_1$, $V_2$, or $V_3$, are applied to deflection electrodes 618 and 620. Accordingly, the method includes determining a plurality of intensities 12, 13, and 14 corresponding to a plurality of voltages $V_1$, $V_2$, and $V_3$, and applying the voltage $V_1$, $V_2$, or $V_3$, corresponding to the maximum of the plurality of intensities 12, 13, and 14 during a scan of the other object.

A technical effect of the herein described system, processor, and method for tracking a focus of a beam includes maintaining the maximum intensity of an intensity memory circuit output signal regardless of expansion of anode 622. Anode 622 expands as a result of heating by electron beam 648 and shifts in the z-direction. The maintenance of the maximum intensity results in a high amount of photon flux through aperture 634 and increases a signal-to-noise ratio of an electrical signal output by detector element 20. Moreover, the maintenance of the maximum intensity helps keep X-ray beam 67 within the acceptance window of primary collimator 624. The maintenance of the maximum intensity improves identification of substance 82 from the diffraction profile and also results in a low false alarm rate of misidentification of a plurality of substances.

Exemplary embodiments of a system, a processor, and a method for tracking a focus of a beam are described above in detail. The system, processor, and method are not limited to the specific embodiments described herein. For example, the method and the processor may be used in combination with other inspection/detection systems.

While various embodiments of the invention have been described, those skilled in the art will recognize that modifications of these various embodiments of the invention can be practiced within the spirit and scope of the claims.

What is claimed is:

1. A method for tracking a focus of a beam, said method comprising:

determining a plurality of intensities corresponding to a plurality of voltages; and applying a first voltage of the plurality of voltages corresponding to a maximum intensity of the plurality of intensities during a scan.

2. A method in accordance with claim 1, wherein said determining a plurality of intensities comprises determining a plurality of intensities by scanning a space between two objects.

3. A method in accordance with claim 1, wherein said applying a first voltage of the plurality of voltages comprises applying the first voltage to a deflection electrode of a radiation source used to generate a diffraction profile.

4. A method in accordance with claim 1, further comprising changing a voltage of an electron beam by applying the first voltage to a deflection electrode of a radiation source used to generate a diffraction profile.

5. A method in accordance with claim 1, further comprising changing a voltage of an electron beam that heats an anode by applying the first voltage to a deflection electrode of a radiation source used to generate a diffraction profile.

6. A method in accordance with claim 1, further comprising storing the first voltage without storing remaining voltages of the plurality of voltages.

7. A method in accordance with claim 1, wherein said determining a plurality of intensities comprises determining a plurality of intensities measured at a point in a space by a transmission detector.

8. A system for tracking a focus of a beam, said system comprising:

a memory area; and a processor configured to:

determine a plurality of intensities corresponding to a plurality of voltages;

store at least one of a plurality of voltages corresponding to the determined plurality of intensities in the memory area; and send a signal to apply a first stored voltage of the plurality of voltages corresponding to a maximum intensity of the plurality of intensities during a scan.

9. A system in accordance with claim 8, wherein said processor configured to determine the plurality of intensities by sending a command signal to scan a space between two objects.

10. A system in accordance with claim 8, wherein said processor configured to send the signal to apply the first voltage to a deflection electrode of a radiation source used to generate a diffraction profile.

11. A system in accordance with claim 8, wherein said processor configured to change a voltage of an electron beam by sending the signal representing the first voltage to a deflection electrode of a radiation source used to generate a diffraction profile.

12. A system in accordance with claim 8, wherein said processor configured to change a voltage of an electron beam that heats an anode by sending the signal representing the first voltage to a deflection electrode of a radiation source used to generate a diffraction profile.

13. A system in accordance with claim 8, wherein said processor configured to command to store the first voltage without commanding to store remaining voltages of the plurality of voltages.

14. A system in accordance with claim 8, wherein said processor configured to determine the plurality of intensities measured at a point in a space by a transmission detector.

15. A system for tracking a focus of a beam, said system comprising:

an X-ray source configured to generate X-rays;

a detector configured to detect the X-rays and generate an electrical output signal representative of the detected X-rays; and a processor configured to:

determine a plurality of intensities corresponding to a plurality of voltages, one of the plurality of intensities corresponding to the electrical output signal; and send a signal to apply a first voltage of the plurality of voltages corresponding to a maximum intensity of the plurality of intensities during a scan.

16. A system in accordance with claim 15, further comprising a first object and a second object, wherein said processor configured to determine the plurality of intensities by sending a command signal to scan defined between the first and second objects.

17. A system in accordance with claim 15, wherein said X-ray source comprises a deflection electrode, wherein said processor configured to send the signal to apply the first voltage to said deflection electrode.

18. A system in accordance with claim 15, wherein said X-ray source comprises a deflection electrode and a cathode configured to generate an electron beam, wherein said processor configured to change an anode position of the electron beam by sending the signal representing the first voltage to said deflection electrode.

19. A system in accordance with claim 15, wherein said X-ray source comprises:

a deflection electrode;

a cathode configured to generate an electron beam; and an anode configured to receive the electron beam, wherein said processor configured to change a voltage of the electron beam that heats said anode by sending the signal representing the first voltage to said deflection electrode.

20. A system in accordance with claim 15, wherein said processor configured to command to store the first voltage without commanding to store remaining voltages of the plurality of voltages.

* * * * *